US006021891A

United States Patent [19]

Anderson

[11] Patent Number: 6,021,891

[45] Date of Patent: Feb. 8, 2000

[54] PENCIL BOX WITH DIFFERENT SIZE SHARPENERS

[76] Inventor: Richard A. Anderson, 2605 SW. Third St., Ankeny, Iowa 50021

[21] Appl. No.: 09/100,647

[22] Filed: Jun. 19, 1998

[51] Int. Cl.[7] ..... A45C 11/34; B43L 23/06

[52] U.S. Cl. ..... 206/214; 206/216; 206/224; 30/454; 220/377

[58] Field of Search ..... 206/214, 224, 206/371, 349, 372, 216; 30/453, 454, 457, 459; 7/160; 451/461; 220/377

[56] References Cited

U.S. PATENT DOCUMENTS

| | | | |
|---|---|---|---|
| D. 335,896 | 5/1993 | Evenson | D19/83 |
| 432,831 | 7/1890 | Legge | 451/461 |
| 565,710 | 8/1896 | Tollner | 206/214 |
| 767,293 | 8/1904 | Kraus | 206/214 |
| 992,749 | 5/1911 | Beckett | 30/453 |
| 2,169,908 | 8/1939 | Wells | 30/454 |
| 2,857,881 | 10/1958 | Beebe et al. | 30/454 |
| 3,206,012 | 9/1965 | Braginetz | 220/377 X |
| 3,429,427 | 2/1969 | Wolf | 206/214 |
| 3,889,809 | 6/1975 | McNair | 206/372 |
| 4,066,109 | 1/1978 | Narang et al. | 30/457 X |
| 4,248,283 | 2/1981 | Kaye | 30/454 |
| 4,281,698 | 8/1981 | Mobius | 30/454 |
| 4,402,354 | 9/1983 | Halpern | 30/454 |
| 4,590,651 | 5/1986 | Roberts | 76/82 X |
| 4,815,622 | 3/1989 | Cramer | 206/214 X |
| 5,441,149 | 8/1995 | Willard et al. | 206/214 |
| 5,774,995 | 7/1998 | Ross | 30/454 |

FOREIGN PATENT DOCUMENTS

| | | | |
|---|---|---|---|
| 3223665 | 3/1983 | Germany | 206/214 |
| 1757610 | 8/1992 | U.S.S.R. | 206/214 |

*Primary Examiner*—Bryon P. Gehman
*Attorney, Agent, or Firm*—Zarley, McKee, Thomte, Voorhees & Sease

[57] ABSTRACT

A pencil box includes a tray for holding pencils, a lid pivotally attached to the tray, at least one pencil sharpener mounted in the lid, and a receptacle for pencil shavings mounted on the lid and having a normally closed door thereon openable to an exposed exterior surface of the lid when the lid is closed on the tray. The pencil box allows a method of sharpening pencils which includes the following steps: providing a pencil box having a lid and a pencil sharpener integrally mounted therein with a door for dumping shavings opening to the exterior of the box, inserting a pencil into the sharpener, sharpening the pencil so as to generate shavings, and opening the door when necessary to discard the shavings without opening the box.

15 Claims, 2 Drawing Sheets

*Fig. 2*

PENCIL BOX WITH DIFFERENT SIZE SHARPENERS

BACKGROUND OF THE INVENTION

This invention relates to the field of containers for writing, drawing and school supplies. More particularly, this invention relates to a pencil box having a built-in sharpener.

Students, artists, architects and engineers often carry their writing utensils and other objects with them in a pencil box. One item sometimes found inside a pencil box is a pencil sharpener. However, the pencil sharpener is typically a hand-held mechanism that is separate from the pencil box itself. Thus, the conventional pencil sharpener is likely to be misplaced and therefore unavailable when needed. Furthermore, many conventional pencil sharpeners do not have a receptacle or container attached thereto for receiving the pencil shavings during the sharpening process. There is a need for a pencil box with a sharpener built in to the box structure. An externally emptiable shavings container associated with such a built-in sharpener would also be useful.

Therefore, a primary objective of the present invention is the provision of a pencil box with a built-in sharpener.

Another objective of the present invention is the provision of a pencil box with a built-in sharpener and shavings receptacle.

Another objective of the present invention is the provision of a pencil box with a built-in sharpener having a shavings receptacle with a door that opens to an exterior surface of the pencil box.

Another objective of the present invention is the provision of a pencil box with a sharpener that is accessible whether the box is open or closed.

Another objective of the present invention is the provision of a pencil box with a plurality of integrally formed sharpener mechanisms therein.

Another objective of the present invention is the provision of a pencil box with a plurality of integrally formed sharpener mechanisms wherein some of the sharpener mechanisms are adapted to sharpen pencils of a different size than the pencils received by the other sharpener mechanisms.

Another objective of the present invention is the provision of a pencil box with a sharpener which is inexpensive to produce, durable, reliable, and easy to use.

These and other objectives will be apparent from the drawings, as well as from the description and claims which follow.

SUMMARY OF THE INVENTION

The present invention relates to a container for sharpenable utensils, such as pencils, crayons and the like. The container has a bottom shell with a top opening. A lid is mounted to the bottom shell to selectively cover the top opening. The lid has an exterior surface which is exposed when the lid is closed. An access hole through the exterior surface of the lid receives a sharpenable utensil. A sharpener mounted on the lid in communication with the access hole receives the sharpenable utensil and discharges shavings from the sharpenable utensil during the sharpening process. A shavings container is disposed within the lid and in communication with the access hole and sharpener so as to receive the shavings as they are discharged. The shavings container has a door accessible from the exterior surface of the lid for emptying the shavings from the shavings container.

A plurality of sharpeners can be mounted in the lid so as to discharge shavings into the shavings container. The access holes in the lid can be of various sizes so as to receive sharpenable utensils of various sizes. For instance, a crayon can be inserted into a sharpener through an opening of one size, and a pencil can be inserted into a sharpener through an opening of another size.

A latch can be provided on the door to the shavings compartment. The door to the shavings compartment can be pivotally and/or integrally attached to the lid.

DETAILED DESCRIPTION OF THE PREFERRED EMBODIMENT

Figure 1:
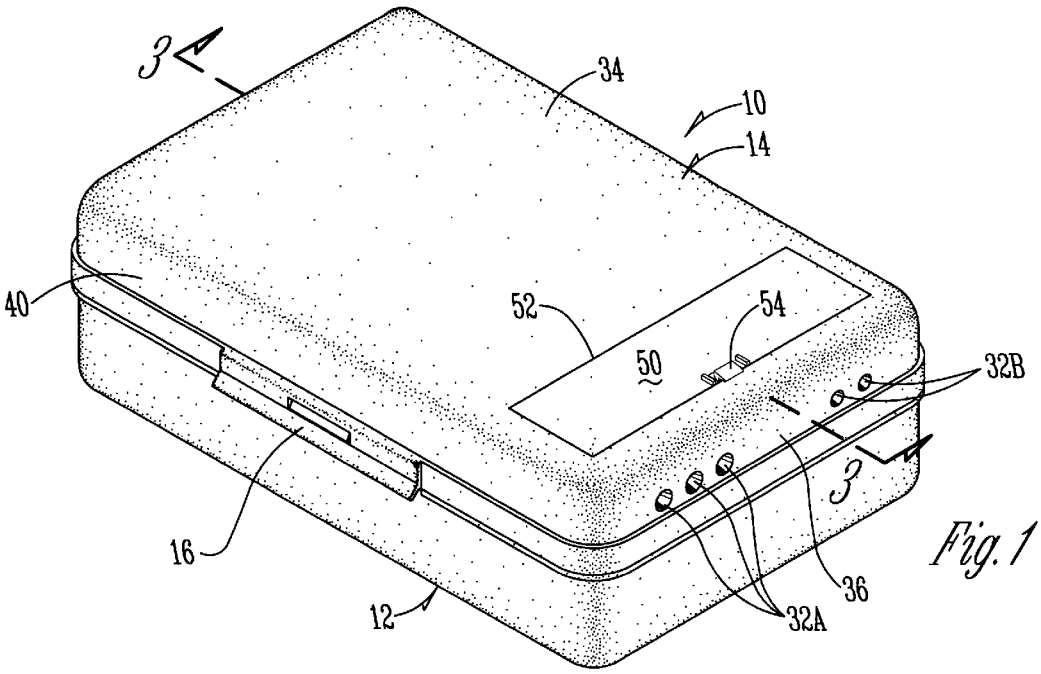
FIG. 1 is a perspective view showing the pencil box of this invention in a closed condition.
Figure 2:
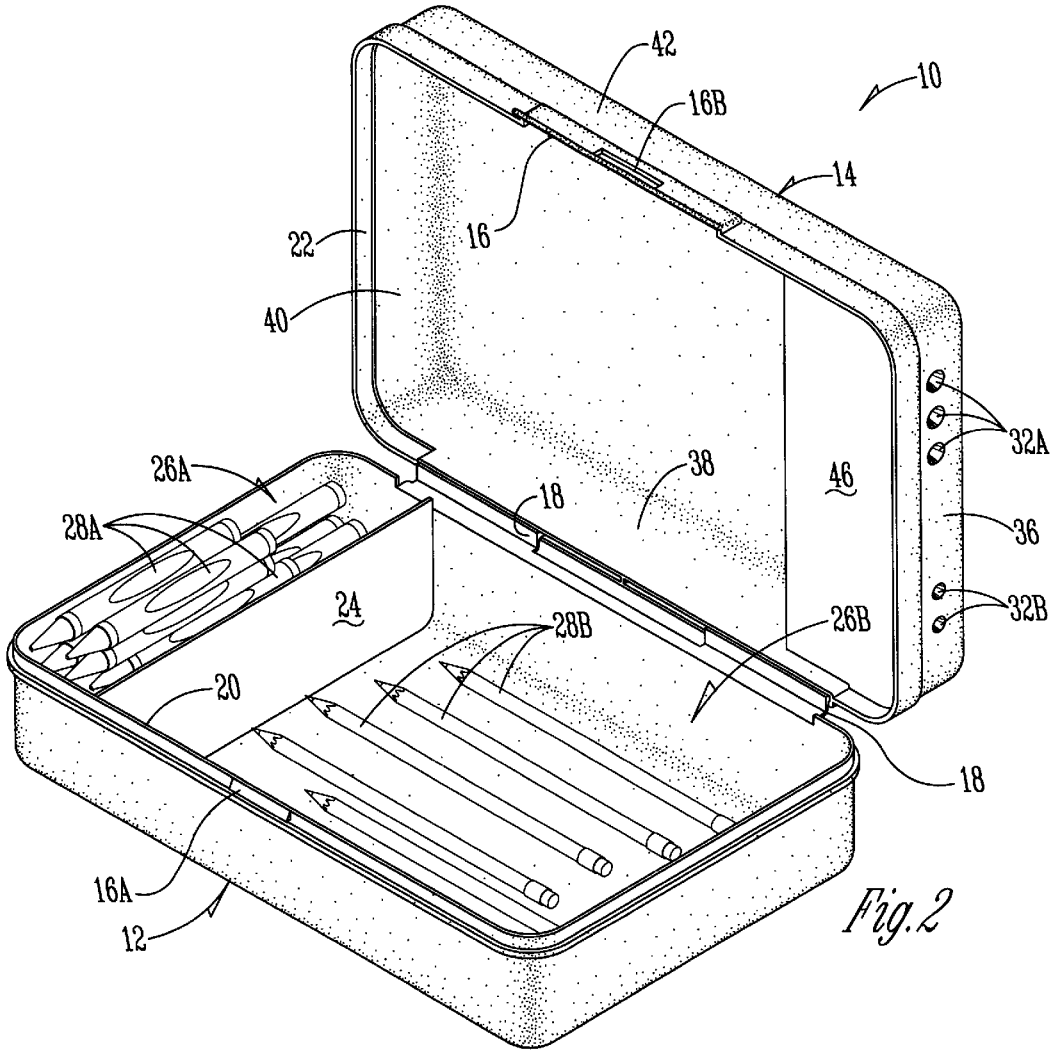
FIG. 2 is a perspective view showing the pencil box of FIG. 1 in an open condition, with the lid raised.

In the figures, the container or pencil box of this invention is generally designated by the reference numeral 10. In FIG. 1, the container 10 has a bottom shell or tray 12 and a lid 14 attached thereto. Preferably the lid 14 is pivotally attached to the shell 12. As best seen in FIGS. 1 and 2, a latch 16 secures the lid 14 to the bottom shell 12. FIG. 2 shows that a hinge 18 pivotally connects the lid 14 with the bottom shell 12. The latch 16 includes a protruding member 16A on the bottom shell 12 which interlocks with a slot 16B on the lid 14. Of course, the relative positions of the latch member 16A, 16B can be reversed, or they can be relocated without detracting from the invention.

The bottom shell 12 and the lid 14 have flanged peripheral lips 20, 22, respectively. The lips 20, 22 interlock overlappingly so as to prevent the contents of the box from being spilled. One or more upright dividers 24 extend across the bottom shell 12 so as to form a plurality of separate compartments 26A, 26B in the shell 12. As shown in FIG. 2, for example, crayons 28A can be placed in the compartment 26A, while lead-type pencils 28B can be stored in the compartment 26B.

Figure 3:
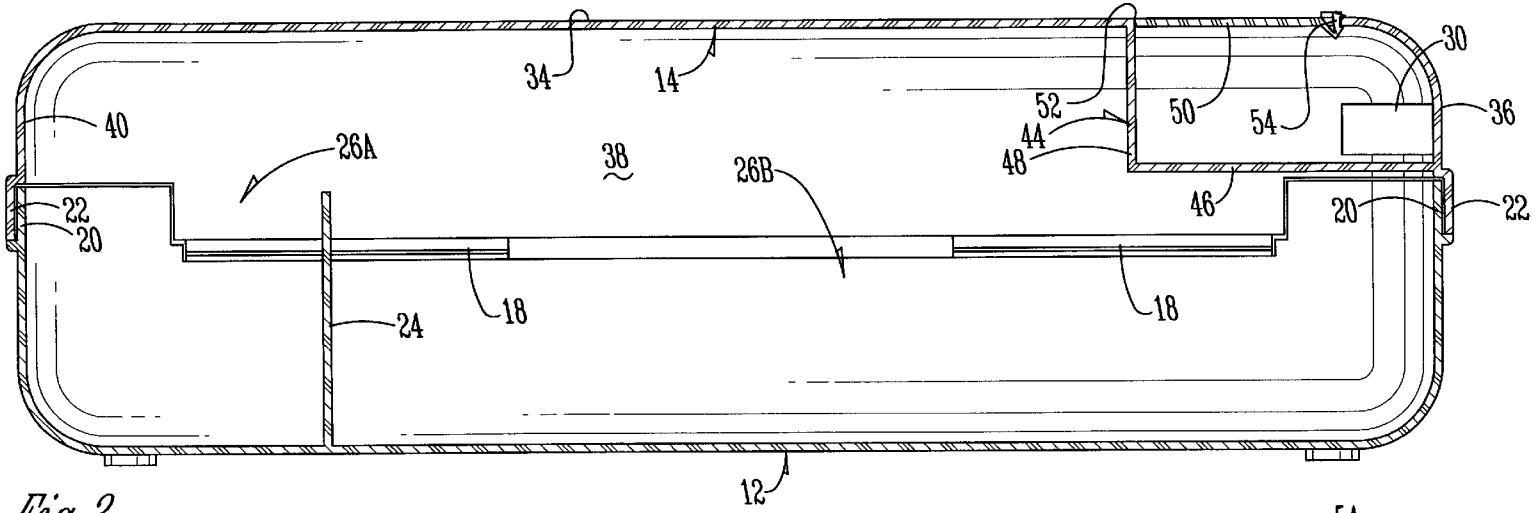
FIG. 3 is a cross-sectional view taken along line 3—3 in FIG. 1 showing the door closed on the shavings compartment of the sharpener which is integrally mounted in the pencil box of this invention.
Figure 4:
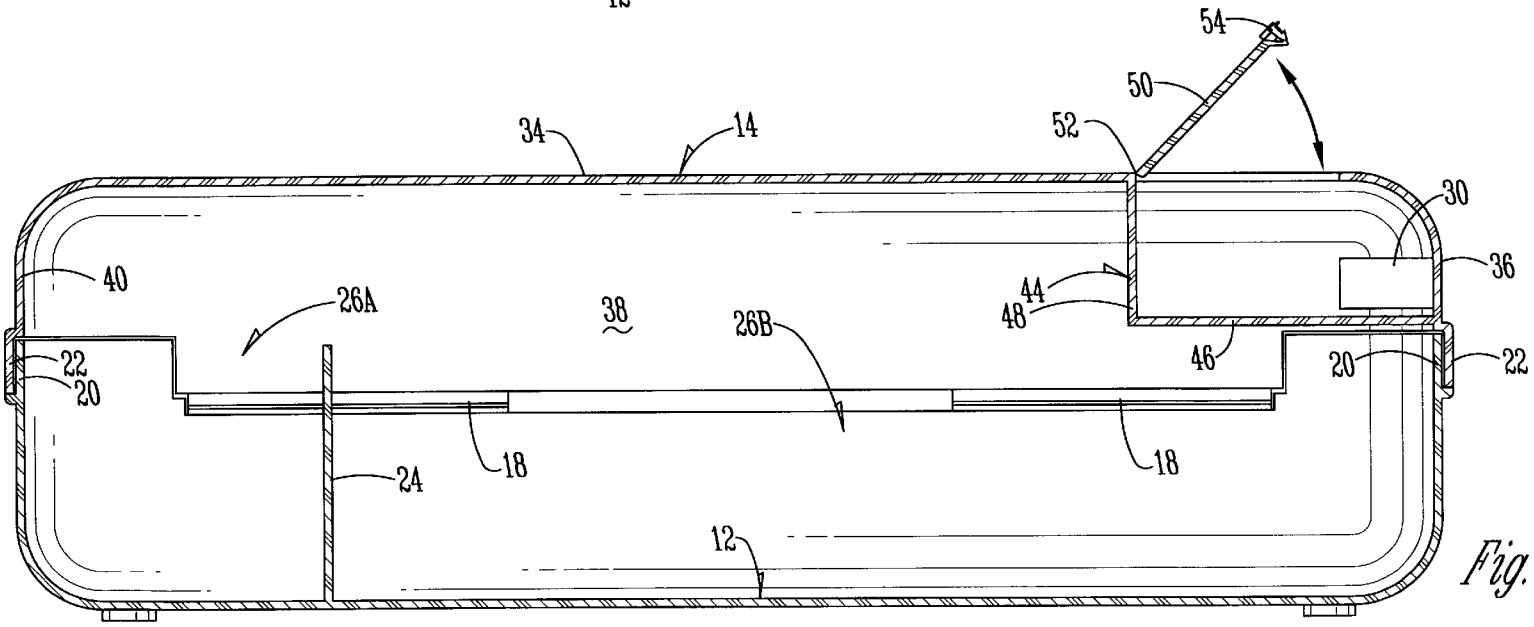
FIG. 4 is a cross-sectional view similar to FIG. 3, but shows the sharpener shavings compartment door open so the shavings can be removed without opening the lid to the box.

Referring to FIGS. 3 and 4, a pencil sharpener 30 is mounted in or, more preferably, integrally formed in the lid 14. Access holes 32A and 32B are provided in the exterior surface of the lid 14. The access holes 32A and 32B extend into the lid 14 in a generally horizontal direction. The lid 14 includes a top 34 and a plurality of sides 36, 38, 40, 42. In the embodiment shown, the access holes 32A, 32B are located in one of the side walls 36, 38, 40, 42. The sharpener or sharpeners 30 are in communication with the access holes 32A, 32B. The access hole 32A is adapted to receive the crayons 28A, which generally have a larger diameter than the pencils 28B. The access hole 32B is adapted to receive the pencils 28B. The sharpeners 30 are located inside the lid 14 adjacent the access openings 32A, 32B.

The sharpener 30 is surrounded by a shavings container 44 which has a bottom 46 and at least one side wall 48. The rest of the container 44 is formed by the lid 14 itself. The compartment 44 has a door 50 thereon which is pivotally attached to the top 34 of the lid 14 by a hinge 52 integrally formed therein. The door 50 to the container 44 is normally closed, but is openable to an exposed exterior surface of the lid 14, whether the lid 14 is opened or closed. A latch 54 opposite the hinge 52 selectively secures the door 50 to the lid 14, and thereby secures the lid 50 to the shavings container 44.

In use, the point of the crayon 28A, pencil 28B, or other sharpenable utensil is inserted into the appropriate access hole 32A, 32B and rotated so as to engage the conventional sharpening blade (not shown) of the sharpener 30. The sharpening process generates shavings which fall into, and eventually fill, the shavings container 44. The shavings can be discharged from the shavings container 44 by applying downward and inward pressure on the latch 54 to open the door 50. The shavings can be dumped from the container 44 without opening the pencil box 10. However, the shavings can also be emptied with the pencil box open.

The method of sharpening pencils made possible by this invention includes the steps of providing a pencil box with a pencil sharpener integrally mounted therein with a door for dumping shavings opening to the exterior of the box, inserting a pencil into the pencil sharpener, sharpening the pencil, and when necessary, discharging the shavings with or without opening the lid. The pencil is sharpened in a conventional manner by rotating the pencil relative to the sharpener or rotating the sharpening blade.

Other uses of this pencil box are contemplated. For instance, eyebrow pencils and lipstick pencils could be stored and sharpened with such a container.

In the drawings and specification, there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A container for sharpenable utensils comprising:

a bottom shell having a top opening;

a lid mounted to the bottom shell so as to selectively cover the top opening, the lid having an exterior surface which is exposed when the lid is closed, more than one access hole through the exterior surface of the lid being adapted to receive sharpenable utensils, whereby at least two of the access holes are of different sizes to receive sharpenable utensils of different sizes;

more than one sharpener mounted on the lid and in communication with the access holes so as to receive sharpenable utensils for sharpening, the sharpeners being adapted to remove shavings from the sharpenable utensils, whereby at least two of the sharpeners are of different sizes to fit sharpenable utensils of different sizes; and a shavings container disposed within the lid and in communication with the access holes so as to receive the shavings, the shavings container having a door accessible from the exterior surface of the lid for emptying the shavings from the shavings container.

2. The container of claim 1 further including means to hingeably mount the lid on the bottom shell.

3. The container of claim 1 wherein the hole extends into the lid in a generally horizontal direction.

4. The container of claim 1 comprising a latch mounted on the lid and the bottom shell for securing the lid to the bottom shell.

5. The container of claim 1 comprising a door latch mounted on the door and the lid for securing the door to the lid.

6. The container of claim 1 wherein the door is pivotally attached to the lid.

7. The container of claim 1 wherein the door is integrally formed with the lid.

8. The container of claim 1 wherein the bottom shell has a an upright divider extending thereacross so as to form a plurality of separate compartments in the bottom shell.

9. The container of claim 1 wherein the shavings container has a bottom wall and at least one side wall connected to an interior surface of the lid adjacent the access hole.

10. A container according to claim 1 wherein the sharpenable utensils are selected from the group consisting of pencils, crayons, eyebrow pencils, and lipstick pencils.

11. A box for holding sharpenable utensils comprising:

a tray for holding sharpenable utensils;

means for pivotally attaching a lid to the tray, said lid having external and internal surfaces;

more than one sharpener mounted in the lid, whereby at least two of said sharpeners are of different sizes to fit sharpenable utensils of different sizes;

more than one access hole in the external surface of the lid, said access holes extending into the lid in a horizontal direction and said access holes being in communication with the pencil sharpeners, whereby at least two of said access holes are of different sizes to fit sharpenable utensils of different sizes; and a receptacle for pencil shavings mounted on the lid and having a normally closed door thereon openable to an exposed exterior surface of the lid when the lid is closed on the tray.

12. The pencil box of claim 11 wherein the receptacle is disposed inside the lid.

13. The pencil box of claim 11 wherein the lid has a top and a plurality of sides, the sharpener being mounted to one of the sides.

14. The pencil box of claim 11 wherein the door is integrally formed with the lid.

15. The pencil box of claim 11 comprising a door latch mounted on the door and the lid for securing the door to the lid when the lid is closed.

* * * * *